United States Patent [19]

Hait

[11] Patent Number: 4,508,094

[45] Date of Patent: Apr. 2, 1985

[54] CONVERTIBLE COOKING UNIT

[75] Inventor: Paul W. Hait, Saratoga, Calif.

[73] Assignee: Pyromid, Inc., Los Gatos, Calif.

[21] Appl. No.: 440,984

[22] Filed: Nov. 12, 1982

[51] Int. Cl.[3] ..... F24C 1/16

[52] U.S. Cl. ..... 126/9 R; 126/9 B

[58] Field of Search ..... 126/2, 3, 4, 9 R, 9 A, 126/9 B, 11, 25 R, 25 A, 25 B, 25 AA, 26, 29, 30, 275 R, 211, 218; 219/454, 340, 472, 473, 474; 99/340, 449, 339, 456, 447

[56] References Cited

U.S. PATENT DOCUMENTS

| | | | |
|---|---|---|---|
| 700,356 | 5/1902 | Mitchell . | |
| 1,090,045 | 3/1914 | Gladden . | |
| 1,238,142 | 8/1917 | Hitchcock . | |
| 1,438,345 | 12/1922 | Tair et al. | 126/9 R |
| 1,651,818 | 12/1927 | Gorrell | 126/30 X |
| 2,001,615 | 5/1935 | Karten | 99/447 |
| 2,237,081 | 4/1941 | Owens | 126/25 R |
| 2,469,778 | 5/1949 | Morici | 126/281 |
| 2,469,885 | 5/1949 | Molla | 126/144 |
| 2,515,521 | 7/1950 | Laffredo | 126/9 B |
| 2,576,750 | 11/1951 | Clark | 312/259 |
| 2,985,164 | 5/1961 | Imoto | 126/25 |
| 3,027,887 | 3/1962 | Krohncke | 126/25 |
| 3,327,698 | 6/1967 | Leslie | 126/9 R |
| 3,384,066 | 5/1968 | Tufts | 126/9 |
| 3,489,131 | 4/1968 | Richins | 126/9 |
| 3,664,321 | 5/1972 | Chioo | 126/9 R |
| 3,667,446 | 6/1972 | Morton | 126/9 R |
| 3,682,154 | 8/1972 | Mollere | 126/9 A |
| 3,765,397 | 10/1973 | Henderson | 126/9 R |
| 3,809,051 | 5/1974 | Giroux | 126/9 R |
| 3,880,139 | 4/1975 | Young | 126/9 R |
| 3,915,144 | 10/1975 | Tomita | 126/9 R |
| 4,023,553 | 5/1977 | London et al. | 126/25 B |
| 4,149,514 | 4/1979 | Latouf . | |
| 4,203,427 | 5/1980 | Way | 126/9 R X |
| 4,413,609 | 11/1983 | Tisdale | 126/25 R |

FOREIGN PATENT DOCUMENTS

| | | | |
|---|---|---|---|
| 669321 | 8/1963 | Canada | 126/29 |
| 959365 | 12/1974 | Canada | 126/275 |
| 322959 | 9/1919 | Fed. Rep. of Germany | 126/9 R |
| 674303 | 3/1939 | Fed. Rep. of Germany | 126/9 R |
| 482595 | 3/1917 | France | 126/9 R |
| 7937 | 3/1916 | United Kingdom | 99/447 |
| 192328 | 2/1923 | United Kingdom | 219/474 |

*Primary Examiner*—Larry Jones
*Assistant Examiner*—Carl D. Price
*Attorney, Agent, or Firm*—Jack M. Wiseman

[57] ABSTRACT

A cooking unit includes a truncated pyramidal firebox and a similar support member that are disposed in interlocked relation, and accessories such as grills, and cover members that are adapted to be arranged in several modes to provide different cooking arrangements and to enclose all the members in a compact form for storage or transporting.

14 Claims, 9 Drawing Figures

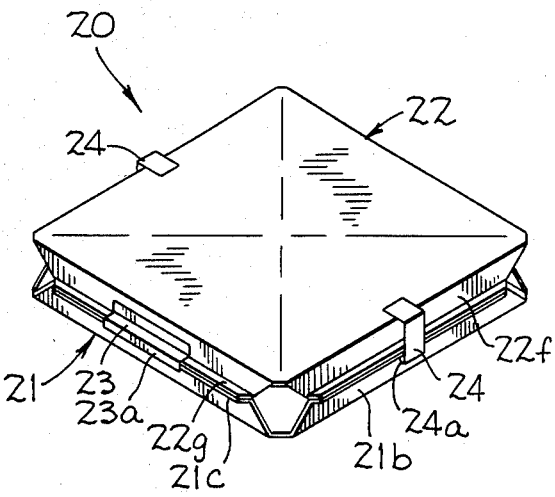
fig_1
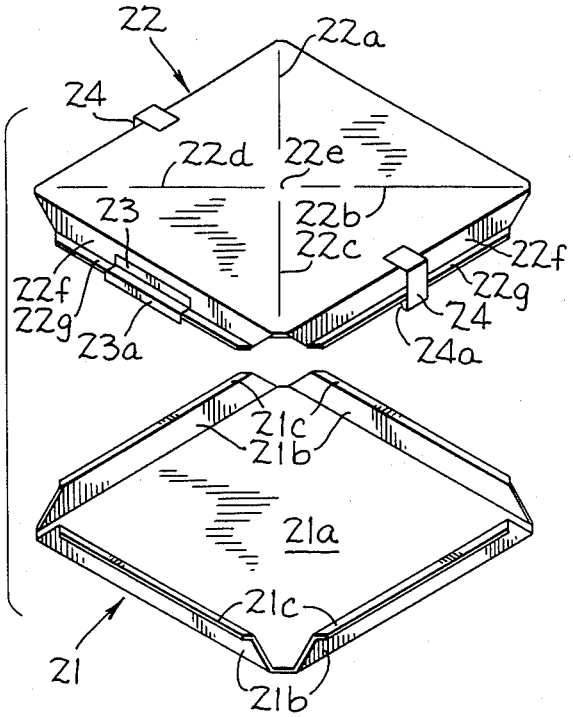
fig_2
fig_3
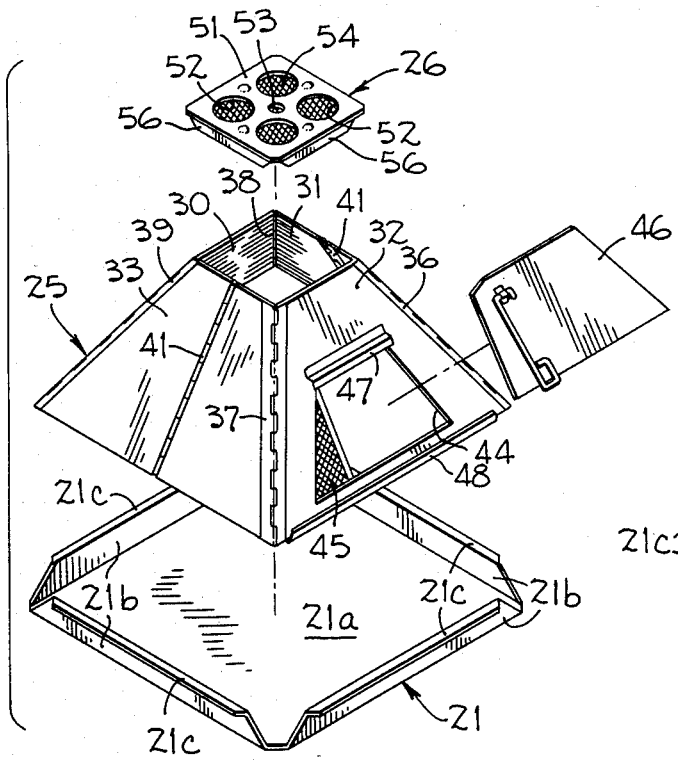
fig_4
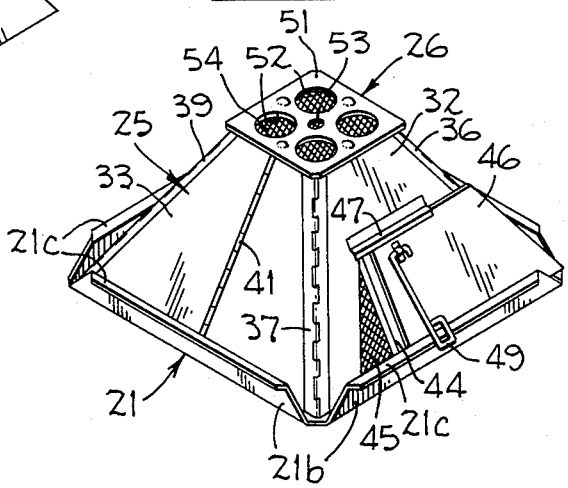

fig_5
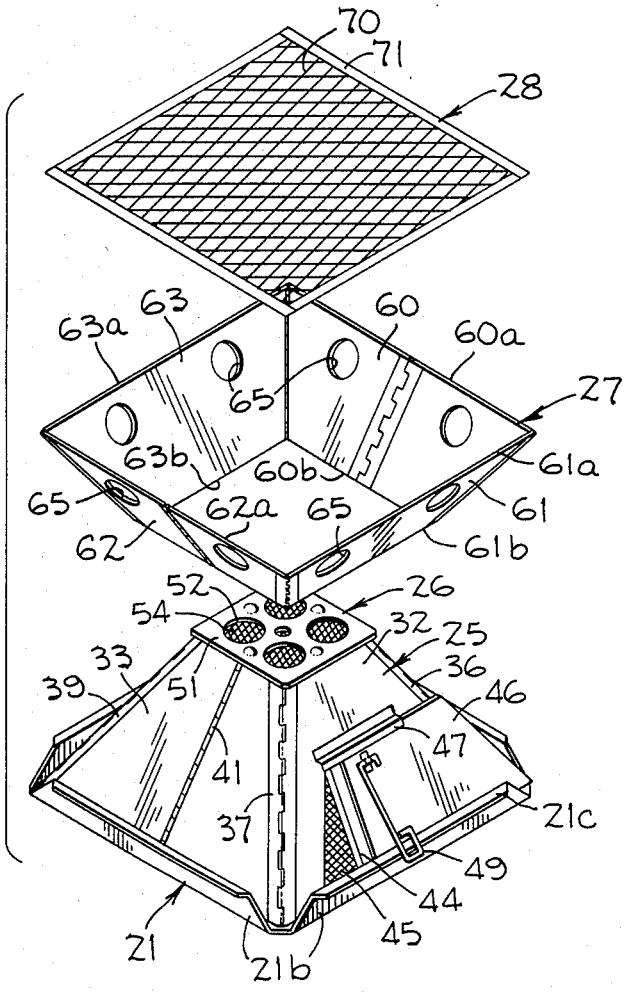
fig_6
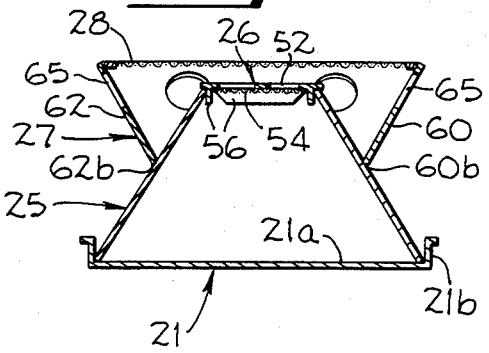
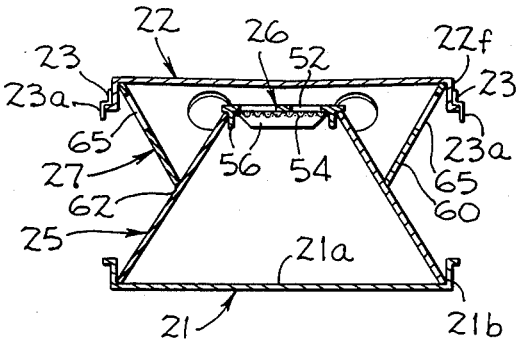
fig_7
fig_8
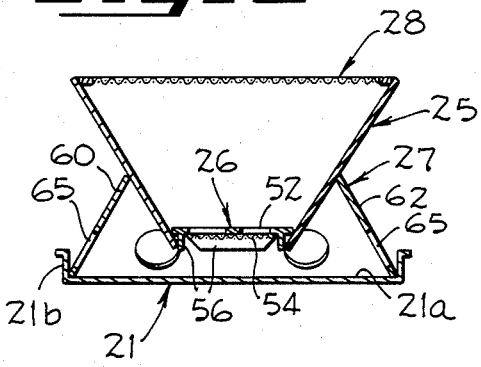
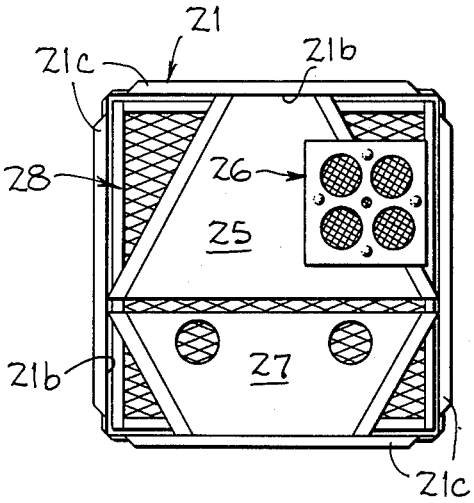
fig_9

CONVERTIBLE COOKING UNIT

BACKGROUND OF THE INVENTION

Cooking units that are adapted to be disassembled and effectively enclosed in a container for ease of transporting on a camping trip or the like are already available. One such unit, which is disclosed in my pending application Ser. No. 378,111, filed May 14, 1982, now U.S. Pat. No. 4,489,706 is particularly adapted to be used outdoors as an environmentally enclosed heating and cooking system. Other cooking units, that are customarily used on patios for barbequing and the like, have provisions for disassembling or collapsing to promote easy storage. However, the arrangement of the parts of a cooking unit that is used in outdoor cooking is considerably different than the arrangement of parts of cooking units used for patio cooking. In view of the fact that many people who participate in outdoor camping activities occasionally desire to enjoy the experience of patio cooking there is a need for a convertible cooking unit that may be arranged in a compact form for ease in transporting and storage and is capable not only of being used in a camping atmosphere to perform the several heating and cooking functions that are required around the campfire but also of being used to carry out specialized cooking functions, such as hibachi cooking, that are associated with patio-living.

It is an object of the present invention to provide a cooking unit that is convertible for use in a variety of cooking functions and is also adapted to be quickly disposed in a compact, collapsed form for ease in storing and transporting.

SUMMARY OF THE INVENTION

A cooking unit includes a basic truncated pyramidal firebox and an adapter in the form of a truncated pyramidal support member that is selectively positionable on the firebox to convert the firebox for various cooking procedures.

DESCRIPTION OF THE DRAWINGS

FIG. 1 is a perspective of the unit of the present invention shown in its compact transporting and storing mode.

FIG. 2 is an exploded perspective of the two members of the unit which form the container when the unit is arranged in the FIG. 1 mode.

FIG. 3 is an exploded diagrammatic perspective of the firebox of the cooking unit of the present invention and members of the unit that are closely associated with the firebox.

FIG. 4 is a diagrammatic perspective of the apparatus of FIG. 3 in an operative position.

FIG. 5 is an exploded diagrammatic perspective of the unit with elements added to the unit of FIG. 4 to convert it for additional cooking functions.

FIG. 6 is a diagrammatic transverse vertical section taken through the unit of FIG. 5 when it is assembled.

FIG. 7 is a diagrammatic transverse vertical section similar to FIG. 6 but showing a top member substituted for the top member of FIG. 6.

FIG. 8 is a diagrammatic vertical section similar to FIG. 6 but showing the unit in a position inverted from that of FIG. 6 and certain members repositioned.

FIG. 9 is a diagrammatic plan of the unit showing members positioned on the member that acts as the lower cover of the container.

DESCRIPTION OF A PREFERRED EMBODIMENT

The convertible cooking unit of the present invention includes a container 20 (FIG. 1) which has a base 21 and a cover 22. These members form a container which is adapted to enclose all the other elements of the cooking unit, however, they also act as operating parts of the cooking unit, the base 21 being arranged to act as a fuel-supporting and heat-reflecting member for the unit, as seen in FIGS. 3 and 4, and the cover member 22 serving as a griddle in the arrangement of the members shown in FIG. 7.

With the exception of the griddle 22, the entire unit is shown in FIG. 5 and includes the base 21, a firebox 25, a small grill 26, a support member 27 and a large grill 28. All elements of the unit are made of stainless steel.

The base 21 (FIG. 2) comprises a central, generally flat portion **21*a* of square configuration on which fuel may be supported while it is burning, and four upturned flanges 21*b* that are formed integrally with and project away from the central portion 21*a* at generally right angles relative thereto. A second, relatively narrow flange 21*c* extends outwardly from the edge of each flange 21*b***.

The cover or griddle 22 (FIG. 2) has a central section defined by four quadrants separated by creases **22*a*–22*d*. The quadrants and the creases are inclined, at a very shallow angle, downwardly and inwardly toward a central area 22*e* so that liquid material, such as grease, will drain toward this area. At each side the cover 22 has a depending flange 22*f* that carries an outwardly projecting narrow flange 22*g* at its lower end. When the cover is placed in container-closed position over the base 21, the four flanges 22*g* of the cover abut the four flanges 21*c* of the member 21. A bracket 23, that is secured to a flange 22*f* at one side of the cover, has an outer lip 23*a* which is positioned closely adjacent the outer edge of one of the flanges 22*g* and extends past the flange 22*g* so that, when the cover is positioned on the base, flange 23*a* will engage the outer edge of a flange 21*c* of the base and align the cover with the base. A second bracket 23 (FIG. 7) is located directly opposite the above-mentioned bracket. Two spring clips 24 are secured to opposite sides of the cover 22 to extend down along the sides of the cover. At its lower end each clip has an inturned edge 24*a* that is inclined upwardly to provide a camming surface. Thus, when the cover is aligned with the base by the two brackets 23, and the cover is moved further downwardly, a flange 21*c* of the base will engage the camming surface of each spring clip 24 and cause the clip to be flexed outwardly. When the flanges 22*g* and 21*c* come into abutting contact, the lower edges 24*a* of the spring clips swing under the flanges 21*c*** to lock the container.

The firebox 25 (FIG. 3) comprises four identically-shaped sides 30, 31, 32 and 33 each of which is trapezoidal in configuration. Side 32 is connected to sides 31 and 33 by elongate hinges 36 and 37, respectively, each of which includes a plurality of short aligned hinge joints. Similarly, side 30 is connected to sides 31 and 33 by hinges 38 and 39, respectively. Each of the sides 31 and 33 comprises two identical plate members pivotally connected along straight side edges by a hinge 41. An opening 44 in side 32 is partially covered by a triangular spark-arresting screen 45, and a damper 46 in the form of a flat plate is mounted for sliding movement over the opening 44 and over the screen by upper and lower guide tracks 47 and 48 respectively. A handle 49, pivotally connected to the damper, may be used to move the damper to desired positions.

The small grill 26 (FIG. 3) comprises a square plate 51 having four large holes 52 and one smaller hole 53 extending therethrough. A screen 54 is riveted to the plate so that it underlies the holes 52 and 53. The plate 51 also has four flanges 56 (two only being shown in FIG. 3) secured to or integrally formed therewith and arranged to project outwardly from the undersurface of the plate, one flange being positioned a short distance inwardly from each of the side edges of the plate. The size of the small grill 26 is such that the plate 51 completely covers the square opening at the upper end of the firebox 25, and the four flanges 56 that extend downwardly from the plate 51 are so positioned that they extend into the opening, with the flanges lying close to the edges that define the opening, as seen in FIGS. 6 and 7.

The support member 27 (FIG. 5) is identical in construction to the firebox 25 except that the four pivotally connected sides 60–63 of member 27 are not as high as the sides 30–33 of the firebox, and each of the walls 60–63 has two relatively large holes 65 therein. The square defined by the upper edges **60*a*–63*a* of the sides is exactly equal to the size of the square defined by the lower edges of the firebox 25, while the square defined by the lower edges 60*b*–63*b* of the sides is considerably larger than the square defined by the upper edges of the firebox. Accordingly, when the support member 27 is positioned over the firebox, as seen in FIG. 6, the lower edges 60*b*–63*b*** engage the side faces of the firebox walls at positions intermediate the upper and lower ends of the firebox.

The large grill 28 is square in configuration and includes a grid 70 enclosed by a rim 71. The grill is so dimensioned that it will nest within the upper end of the support member 27, as seen in FIG. 6, and within the upper end of the firebox 25 when the firebox is inverted as seen in FIG. 8.

One operating arrangement of the cooking unit of the present invention is shown in FIGS. 3 and 4 wherein the firebox 25 is positioned on the base 21, and the small grill is positioned on the upper end of the firebox. It is evident that this arrangement provides a cooking unit in which a fire built on the base 21 is completely protected from the elements and is provided with adequate combustion air by the damper-controlled opening in the firebox. Further, the pyramidal shape of the firebox focuses the heat energy to the center of the unit and particularly to the small grill 26 which, of course, is adapted to support a pot or pan.

A second arrangement of the cooking unit is illustrated in FIGS. 5 and 6 wherein the support member 27 has been positioned on the firebox and the large grill 28 is in place on the upper end of the support member. Since, in one embodiment, the large grill is approximately twelve inches on a side, a surface is provided that is adapted to support more than one pot or pan. Further, heat that passes through the small grill 26, and heat that radiates outwardly from those portions of the firebox wall that are enclosed by the support member 27, is directed against the undersurface of the entire grill. It is also to be noted in FIG. 6 that the space between the inner surfaces of the walls of the support member and the firebox wall provides an oven in which food may be prepared.

In FIG. 7, the container cover or griddle 22 has been substituted for the large grill 28. As mentioned above, the cover is constructed to form a griddle on which various items, such as bacon and pancakes, can be prepared.

A fourth arrangement of the cooking unit is illustrated in FIG. 8 wherein the support member 27 is positioned in upright relation on the base 21, and the firebox 25 is positioned in inverted relation on the support member 27. Also, the small grill 26 is disposed in the lower end of the firebox, and the large grill 28 is positioned across the upper end of the firebox. A hibachi or charcoal brazier is thus provided wherein the briquets can be burned on the small grill 26 and the area of the firebox around the grill while food is cooked on the grill 28. Combustion air is brought in through the holes 65 in the member 27 and up through the openings in the small grill.

The manner in which all the operating elements of the cooking unit are arranged so that it can be conveniently stored or transported is illustrated in FIG. 9. First, the large grill 28 is placed inside the flanges **21*c* of the base 21. The firebox 25 and the support member 27 are folded and laid on the grill 28. Referring to FIG. 3, it will be seen that the folding of the firebox is carried out by first collapsing the side walls 31 and 33 inwardly. As the sections of these walls move inwardly, the walls 30 and 32 are drawn toward each other. In its folded position, the firebox is a substantially flat member. The support member 27** is folded in the same manner to form a flat unit.

After the flattened firebox and the flattened support member are positioned on the grill 28, the small grill 26 is laid over the firebox or the support member. Then the griddle or cover 22 is positioned over the assembled members and aligned with the base 21 by means of one or both guide brackets 23. When the cover is aligned with the base, the cover is moved downwardly, causing the camming edges **24*a* of the spring clips 24 to engage underlying flanges 21*c* and be forced outwardly. When the four flanges 22*g* engage the flanges 21*c*, the edges 24*a* of the clips swing under the associated flanges 21*c*** and lock the cover on the base.

From the foregoing description it will be evident that the present invention provides a unique cooking unit which will accommodate various cooking operations ranging from a single pot-heating operation, to grilling, baking and hibachi cooking.

I claim:

1. A cooking unit comprising an open-ended support member of truncated pyramidal configuration, an open-ended firebox of truncated pyramidal configuration disposed in axial alignment with said support member and having the smaller end of said firebox projecting through the opening in the smaller end of said support member, at times said support member is inverted and is positionable over said firebox with the smaller end of said firebox projecting through the opening in the smaller end of said support member, said support member and said firebox being formed with a larger end, said support member and said firebox being of a configuration and dimensions for overlapping support, and a grill positionable over the larger upper end of said support member when the unit is oriented with said support member above said firebox, and said grill being positionable over the larger upper end of said firebox when the unit is oriented with said firebox disposed above said support member, said support member comprising panels having trapezoidal configurations and adjacent, non-parallel edges of said panels being hingedly connected for folding and extending said support member, and wherein said firebox comprises panels having trapezoidal configurations and adjacent, non-parallel edges of said panels of said firebox being hingedly connected for folding and extending said firebox.

2. A cooking unit comprising a firebox of truncated pyramidal configuration, and a support member of truncated pyramidal configuration having an opening at its smaller end, said support member being adapted to be disposed in inverted position over said firebox with the smaller end of said firebox projecting through the opening at the smaller end of said support member, with the walls of said firebox enclosed by said support member cooperating with said support member to define an oven extending around the enclosed walls of said firebox and heated by heat radiating therefrom, said support having trapezoidal configurations and adjacent non-parallel edges of said panels being hingedly connected for folding and extending said support member, and wherein said firebox comprises panels having trapezoidal configurations and adjacent, non-parallel edges of said panels of said firebox being hingedly connected for folding and extending said firebox.

3. The cooking unit of claim 2 further including a grill positionable on the larger end of said support member above the oven.

4. The cooking unit of claim 2 wherein said firebox has an opening at its upper smaller end, said unit further comprising a grill positionable across the opening at said upper smaller end of said firebox.

5. The cooking unit of claim 2 further including a griddle positionable on the larger end of said support member above said oven.

6. The cooking unit of claim 2 further including a flat plate adapted to completely underlie said firebox.

7. A cooking unit as claimed in claim 1 wherein each panel of a confronting pair of panels of said support member comprises adjacent plates hingedly connected for folding said support member into a generally flat configuration, and wherein each panel of a confronting pair of panels of said firebox comprises adjacent plates hingedly connected for folding said firebox into a generally flat configuration.

8. A cooking unit comprising:

(a) a first hollow open-ended member having a truncated pyramidal configuration, and having a smaller open end, said first member comprising a plurality of first panels, each of said first panels having a trapezoidal configuration;

(b) a second hollow open-ended member having an inverted truncated pyramidal configuration and having a smaller open end, said second member comprising a plurality of second panels, each of said second panels having a trapezoidal configuration, said second member being disposed above said first member and in axial alignment therewith, said smaller open ends of said first member and said second member being disposed in overlapping relation;

(c) first hinge means hingedly connecting adjacent non-parallel edges of said first panels of said first member for folding and extending said first member;

(d) second hinge means hingedly connected adjacent non-parallel edges of said second panels of said second member for folding and extending said second member; and (e) a cooking grill supported by said second member.

9. A cooking unit as claimed in claim 8 wherein each panel of a confronting pair of first panels of said first member comprises adjacent plates hingedly connected for folding said first member into a generally flat configuration, and wherein each panel of a confronting pair of panels of said second member comprises adjacent plates hingedly connected for folding said second member into a generally flat configuration.

10. A cooking unit as claimed in claim 9 wherein said first member is a support member and said second member is a firebox.

11. A cooking unit as claimed in claim 7 wherein said first member is a firebox and said second member is a support member.

12. A cooking unit as claimed in claim 10 wherein said support member and said firebox are of a configuration and dimensions for overlapping support.

13. A cooking unit as claimed in claim 12 wherein said firebox and said support member are of a configuration and of dimensions for overlapping support.

14. A cooking unit as claimed in claim 9 and comprising a support with upstanding side flanges on which said first member is disposed, a grill disposed in one of said members below said cooking grill, a cover positionable over said support and having said flanges cooperating with the side flanges of said support to define an enclosed space when said cooking unit is in a collapsed state for transporting and storing, said cooking grill and said grill being disposed in said space generally parallel to the plane of said support when said cover is positioned over said support to define the enclosed space, said first member and said second member being folded, respectively, to a generally flat form and disposed in said space generally parallel to the plane of said support when said cover is positioned over said support to define the enclosed space, and means locking said cover to said support when said grill, said cooking grill, said folded first member and said folded second member are disposed in said enclosed space.

* * * * *